United States Patent [19]

Porowski

[11] Patent Number: 4,949,781

[45] Date of Patent: Aug. 21, 1990

[54] COOLING APPARATUS

[75] Inventor: Jan S. Porowski, Pittsburgh, Pa.

[73] Assignee: SMC O'Donnell Inc., Pittsburgh, Pa.

[21] Appl. No.: 326,010

[22] Filed: Mar. 20, 1989

[51] Int. Cl.[5] ..... F28D 7/10; F28F 11/00

[52] U.S. Cl. ..... 165/11.1; 165/81; 165/134.1; 165/180; 266/172; 75/595

[58] Field of Search ..... 165/70, 76, 81, 134.1, 165/911, 180, 11.1, 110; 75/595; 266/172

[56] References Cited

U.S. PATENT DOCUMENTS

| | | | |
|---|---|---|---|
| 1,782,829 | 11/1930 | Nash et al. | 165/134.1 |
| 2,045,561 | 6/1936 | Smithells | 165/134.1 |
| 2,332,336 | 10/1943 | Norris | 165/134.1 |
| 2,416,255 | 2/1947 | Griswold, Jr. et al. | 75/595 |
| 3,777,502 | 11/1973 | Michie III et al. | 165/154 |
| 4,254,819 | 3/1981 | Worrell | 165/911 |
| 4,290,804 | 9/1981 | Avery | 75/595 |
| 4,403,385 | 9/1983 | Kirk | 165/70 |
| 4,723,602 | 2/1988 | Huigen et al. | 165/70 |

FOREIGN PATENT DOCUMENTS

| | | | |
|---|---|---|---|
| 0133544 | 10/1981 | Japan | 165/911 |

OTHER PUBLICATIONS

Flugge, W. , Handbook of Engineering Mechanics, McGraw-Hill Book Company, N.Y., 1962, pp. 37-14 through 37-15.

*Primary Examiner*—John Ford

*Attorney, Agent, or Firm*—Joseph J. Carducci

[57] ABSTRACT

A cooling apparatus that comprises a first elongated metal tube, a second elongated metal tube longitudinally disposed within the first elongated metal tube having a substantial portion of its outer surfaces out of contact with the inner surface of the first elongated metal tube, with the inner metal tube being adapted to provide passage through it of a hot fluid, and means for cooling the outer surface of the first elongated metal tube, whereby at ambient temperatures the tubes can be easily separated for inspection and at operating temperatures the tubes are substantially in contact with each other.

3 Claims, 1 Drawing Sheet

COOLING APPARATUS

BACKGROUND OF THE INVENTION

1. Field of the Invention

This invention relates to cooling apparatus suitable for cooling a fluid passing therethrough, particularly a molten metal, for example, molten magnesium.

2. Description of Prior Art

A hot fluid can be cooled to a lower temperature level by passing the same through one or more metal tubes whose outer walls are maintained at a temperature below the temperature of said hot fluid by contacting said outer walls with a cooler fluid whose temperature is appreciably below the temperature of said hot fluid. It is apparent that in many cases it is desirable, and sometimes critical, to make certain that there is no contact during such cooling between the hot fluid and the cooling fluid. For example, when the cooling fluid is chemically different from the hot fluid being cooled, mixture of the two would result in contamination of the hot fluid with the cooling fluid, resulting in purification steps that might not be economically feasible. If the hot fluid being cooled is composed of molten metal, for example, molten magnesium, and the cooling fluid is a normal cooling liquid, such as water, contact between the two could lead to disastrous results.

Cooling apparatus can be designed that, for a period of time, will reasonably avoid the contact of the hot fluid with the cooling fluid. For example, the tube through which the hot fluid will pass can be inserted inside a second tube, wherein the outer surface of the inner tube is in intimate contact with the inner surface of said second tube. Since the surfaces of the two tubes are thus in intimate contact with each other, it would be expected that heat transfer between the walls of the two tubes would not be adversely affected thereby. But even more important, failure by way of a crack or an opening in one wall of one of the two tubes would still not result in intermixture of the hot fluid with the cooling fluid.

However, to insure that at some point a similar failure does not occur in the wall of the remaining tube, periodic inspections of the tubes, or the replacement thereof, becomes necessary. Replacement of the tubes is obviously expensive. Inspection of each tube, when they have been assembled, as described above, so that the surfaces thereof are in intimate contact with each other, is very difficult or virtually impossible. This is so, because when they are assembled, they must be prestressed. This is done by heating the outer tube while cooling the inner tube and then inserting one tube inside the other while they are in such state. When the two tubes reach ambient temperature, the inner tube will fit snugly within the outer tube. Separation of the tubes from each other thereafter cannot be done easily and in some cases will be virtually impossible. This means that the inner surface of the outer tube and the outer surface of the inner tube cannot effectively be examined and inner surface of the inner tube may be examined but with great difficulty. Therefore, in situations wherein the cooling apparatus has been designed, as defined above, the same cannot effectively be inspected and will have to be periodically replaced, with added expenses.

SUMMARY OF THE INVENTION

I have found that the difficulties defined above can be easily obviated, and the desired cooling results will still be obtained, with a novel apparatus, claimed herein, comprising a first elongated metal tube, a second elongated metal tube longitudinally disposed within said first elongated metal tube and having a substantial portion of its outer surface out of contact with the inner surface of said first elongated metal tube, said second longitudinal inner metal tube adapted to provide passage therethrough of a hot fluid, and means for cooling the outer surface of said first elongated metal tube.

BRIEF DESCRIPTION OF THE INVENTION

Figure 1:
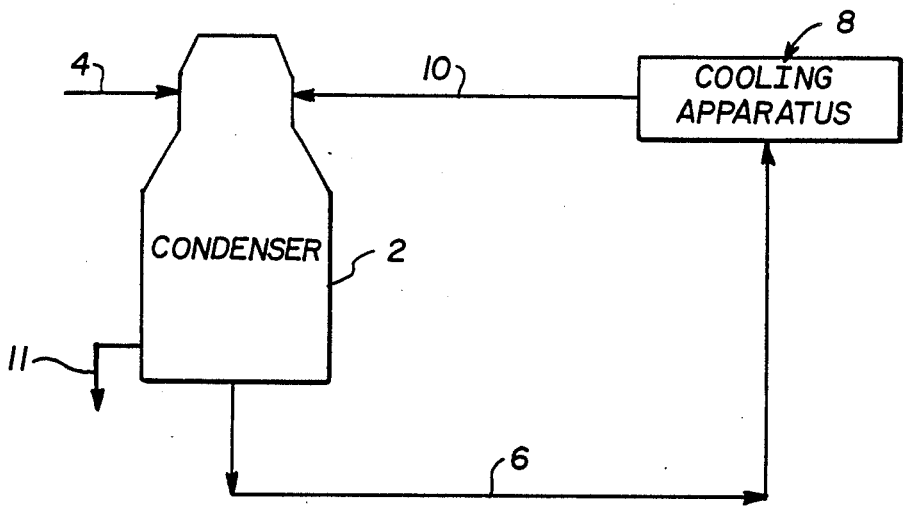
FIG. 1 is a schematic representation of the environment in which my novel cooling apparatus is used to cool a fluid therein.

Referring to FIG. 1, reference numeral 2 refers to a condenser into which a fixed amount of a hot liquid, such as molten magnesium, is initially introduced, for example, by line 4 from a source not shown. The hot liquid is removed from condenser 2 by line 6 and is introduced into my novel cooling apparatus 8, wherein cooling is effected, and the cooled liquid product is then returned to condenser 2 by line 10. Then magnesium vapors are introduced into condenser 2, for example, by line 4. The cooled molten magnesium entering condenser 2 mixes with the entering magnesium vapors, as a result of which the magnesium vapors are condensed, increasing the amount of molten magnesium in condenser 2. The resulting increased amount of molten magnesium can be removed from condenser 2, as required, intermittently or continously, for example, by line 11.

Figure 2:
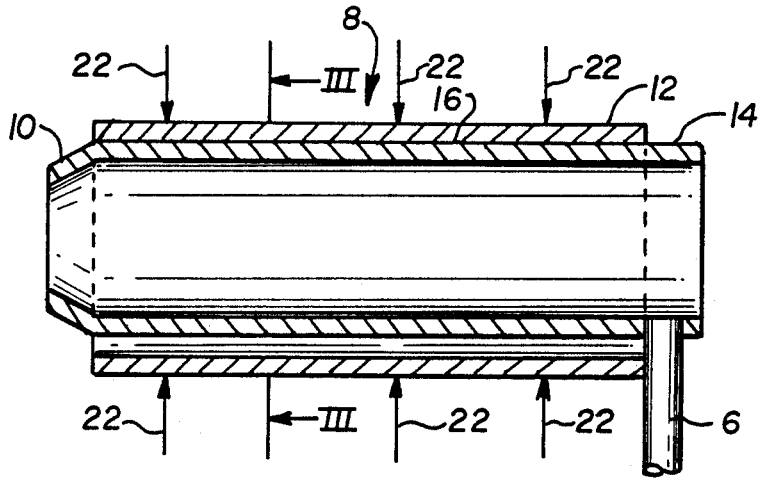
FIG. 2 is a cross-section of our novel claimed cooling apparatus.
Figure 3:
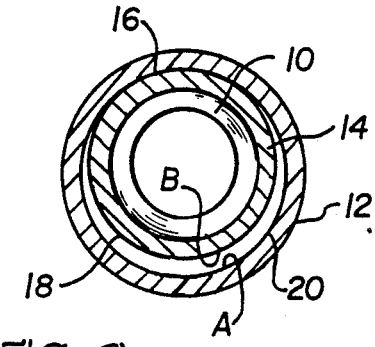
FIG. 3 is a section taken along III—III in FIG. 2.

Referring to FIGS. 2 and 3, it can be seen that my novel cooling apparatus comprises a first elongated metal tube 12 and a second elongated metal tube 14 longitudinally disposed within first elongated metal tube 12. As can be seen in FIGS. 2 and 3, the preferred embodiment, first elongated metal tube 12 merely lies on the second elongated metal tube 14 and the two have a minimum surface contact 16 therebetween. Indeed, it is apparent that second elongated metal tube 14 has a substantial portion of its outer surface 18 out of contact with the inner surface 20 of first elongated metal tube 12. Thus, first elongated metal tube 12 can be removed with ease from its position relative to second elongated metal tube 14 and each can be inspected when desired and replaced, if necessary.

But it is also necessary that the walls of the two metal tubes be in such proximity to each other that the heat transfer capabilities of the two walls are the same, or at about the same level, that they would have been had the two walls remained in intimate contact with each other, for otherwise the cost of cooling the hot liquid would have been prohibitively high. I have found that it is critical, therefore, to obtain the desired heat transfer, while permitting the easy separation of the two elongated, metal tubes herein, that the distance between a point A on the inner surface of first elongated metal tube 12 and the closest adjacent point B on the outer surface of second elongated metal tube 14 bein the range of about 0.01 to about 2.0 percent, preferably between about 0.02 to about 0.5 percent, of the inner diameter of the first elongated metal tube 12.

The means for cooling the walls of the two elongated metal tubular members is not critical and can include any suitable or desired apparatus or cooling medium. In a preferred embodiment, this can be done by directing a spray of a cooling liquid, for example water, at ambient or any suitable temperature, using a plurality of nozzles 22, onto the outer surface of first elongated tubular member 12. The liquid, for example, water, and/or vapor, for example, steam, falling off the outer surface of first elongated tubular member 12 can be recovered by any suitable means, not shown, and can be discarded or reused, as desired.

Introducing the hot liquid into the second elongated metal tube 14 with simultaneous cooling of the outer surface of the first elongated metal tube 12 tube results in differential thermal expansion of tube 14 with respect to the tube 12. Such differential expansion reduces and eventually substantially eliminates the distance between the inner surface of tube 12 and the outer surface of tube 14, so that during the cooling operation, the said inner and outer surfaces are substantially in contact with each other, thus improving heat transfer of the resulting double wall to the desired capacity. When the cooling operation is terminated and the unit returns to ambient temperature, the two metal tubes automatically return to the relative positions described and shown in FIGS. 2 and 3.

The elongated metal tubes used in the fabrication of the cooling apparatus herein can be made of any metal suitable for contact with the hot fluid being cooled and that will be satisfactory as a heat transfer component. Thus, when molten magnesium is being cooled, and water is being sprayed, as a cooling medium, elongated metal tube 12 can be made of low alloy steel of type 9 Cr 1 Mo and elongated metal tube 14 can be made of low allow steel of type 9 Cr 1 Mo.

EXAMPLE

In an operation wherein a stream containing molten magnesium amounting to 200 gallons per minute of magnesium, is introduced into cooling apparatus 8 by line 6 at a temperature of about 1,250° to about 1,350° F. and is removed therefrom at an average rate of 200 gallons per minute thereafter by line 10 at a temperature of about 1,125° to about 1,175° F., first elongated metal tube 12 is composed of pipe having an outer diameter 12.75 inches, a length of 10 feet, a thickness of 0.5 inch and an inner diameter of 11.75 inches, while second elongated metal tube 14 is composed of pipe having an outer diameter of 11.73 inches, a length of 11 feet, a thickness of 0.25 inches and an inner diameter of 11.23 inches. The inner surface portion of first elongated metal tube 12 is in line contact with the upper outer surface portion of second elongated metal tube 14, measuring 10 feet along its length. The distance between point A and point B, as seen in FIG. 3, amounts to 0.020 inch.

Obviously, many modifications and variations of the invention, as hereinabove set forth, can be made, without departing from the spirit and scope thereof, and, therefore, only such limitations should be imposed as are indicated in the appended claims.

I claim:

1. A cooling apparatus comprising a first elongated metal tube having a constant diameter, a second elongated metal tube having a constant diameter longitudinally disposed within said first elongated metal tube and having a substantial portion of its outer surface out of contact with the inner surface of said first elongated metal tube, the maximum distance between a point on the inner surface of said first elongated metal tube and the closest adjacent point on the outer surface of said second elongated metal tube being in the range of about 0.01 to about 2.0 percent of the inner diameter of said first elongated metal tube, said second longitudinal inner metal tube adapted to provide passage therethrough of a hot fluid, and means for cooling the outer surface of said first elongated metal tube comprising apparatus for spraying a cooling fluid onto the outer surface of said first elongated metal tube, whereby at ambient temperatures the tubes can be easily separated for inspection and at operating temperatures the tubes are substantially in contact with each other.

2. Apparatus as defined in claim 1 wherein said cooling means comprises apparatus for spraying water onto the outer surface of said first elongated metal tube.

3. Apparatus as defined in claim 1 wherein the distance between a point on the inner surface of said first elongated metal tube and the closest adjacent point on the outer surface of said second elongated metal tube is in the range of about 0.02 to about 0.5 percent of the inner diameter of said first elongated metal tube.

* * * * *